US012678658B2

(12) United States Patent
Byun

(10) Patent No.: US 12,678,658 B2
(45) Date of Patent: Jul. 14, 2026

(54) BENT OVER ROW MACHINE

(71) Applicant: NEWTECH WELLNESS CO., LTD., Gimhae-si (KR)

(72) Inventor: Hyun Jung Byun, Busan (KR)

(73) Assignee: NEWTECH WELLNESS CO., LTD., Gimhae-si (KR)

( * ) Notice: Subject to any disclaimer, the term of this patent is extended or adjusted under 35 U.S.C. 154(b) by 158 days.

(21) Appl. No.: 18/226,803

(22) Filed: Jul. 27, 2023

(65) Prior Publication Data

US 2023/0405395 A1 Dec. 21, 2023

Related U.S. Application Data

(63) Continuation of application No. PCT/KR2022/019661, filed on Dec. 6, 2022.

(30) Foreign Application Priority Data

Jun. 15, 2022 (KR) ..... 10-2022-0072875

(51) Int. Cl.
*A63B 22/00* (2006.01)
*A63B 21/00* (2006.01)
*A63B 21/06* (2006.01)

(52) U.S. Cl.
CPC ..... *A63B 22/0076* (2013.01); *A63B 21/0615* (2013.01); *A63B 21/4034* (2015.10); *A63B 21/4035* (2015.10); *A63B 2022/0082* (2013.01); *A63B 2225/093* (2013.01)

(58) Field of Classification Search
CPC ..... A63B 22/0076; A63B 21/4034; A63B 21/4035; A63B 21/0615; A63B 2022/0082; A63B 2225/093; A63B 21/159; A63B 21/4029; A63B 21/4031
See application file for complete search history.

(56) References Cited

U.S. PATENT DOCUMENTS

| | | | | |
|---|---|---|---|---|
| 5,273,505 | A | 12/1993 | Jones | |
| 10,195,480 | B2 * | 2/2019 | Kelly | A63B 21/4035 |
| 2005/0049121 | A1 | 3/2005 | Dalebout | |
| 2011/0237408 | A1 * | 9/2011 | Rich | A63B 21/16 482/126 |

FOREIGN PATENT DOCUMENTS

| | | | | |
|---|---|---|---|---|
| CN | 108472529 | A * | 8/2018 | A63B 1/00 |
| CN | 216418216 | U | 5/2022 | |
| KR | 10-0479725 | B1 | 3/2005 | |
| KR | 10-2006-0116306 | A | 11/2006 | |
| KR | 20060116306 | A * | 11/2006 | A63B 21/4027 |
| KR | 10-2018-0050032 | A | 5/2018 | |
| KR | 102090777 | B1 * | 3/2020 | A63B 23/12 |

OTHER PUBLICATIONS

International Search Report for PCT/KR2022/019661 mailed Mar. 14, 2023 from Korean Intellectual Property Office.

* cited by examiner

*Primary Examiner* — Loan B Jimenez
*Assistant Examiner* — Jacqueline N L Loberiza
(74) *Attorney, Agent, or Firm* — Revolution IP, PLLC

(57) ABSTRACT

The bent over row machine according to an embodiment of this invention is coupled to the base frame placed in contact with the ground and the upper surface of the base frame and fixed at the main frame, which stands upright in the vertical direction, and at one point on the upper surface of the base frame, providing support for the user's body capable of folding.

9 Claims, 6 Drawing Sheets

BENT OVER ROW MACHINE

TECHNICAL FIELD

This invention works in relation to a bent over row machine. Specifically, this bent over row machine provides a support unit capable of supporting the user's body during exercise by adjusting its height and angle, allowing for the weight to be changed according to the user's body.

BACKGROUND ART

Bent over row is a type of exercise aimed at improving the latissimus dorsi muscles during in weight training, which is acknowledged for creating balanced back muscles. This bent over row machine can be exercised by holding dumbbells with both hands to bend the upper body about 80 degrees forward with the knees slightly bent, then bending the arms to pull the dumbbells to the lower part of the pectoralis major muscle, and returning to the original position.

When performing exercises using dumbbells, it may be difficult for beginners to carry out the procedure in proper postures, which may cause them to perform exercises in the wrong posture or strain the body, also often leading to safety accidents such as dropping dumbbells.

In addition, when performing exercises using dumbbells, relevant issues may arise such as performing only with the weight of the dumbbells that are personally owned by the user and performing only with a limited angle of rotation of gravity.

Therefore, research on bent over row machines is required as this machine provides a support unit capable of supporting the user's body during exercise by adjusting its height and angle, allowing for the weight to be changed according to the user's body.

PRIOR ART LITERATURE

Patent Literature (Patent Document 1) Korea Patent Registration No. 10-0479725

DISCLOSURE OF INVENTION

Tasks to be Resolved

This invention aims to provide a bent over row machine capable of performing exercises in a correct posture via a support unit capable of supporting the user's body.

This invention also aims to provide a bent over row machine capable of adjusting the relevant height and angle of a support unit according to various types of users' bodies.

In addition, this invention aims to provide a bent over row machine capable of performing exercises not only in a position in which the chest and abdomen are supported but also in a bent-over state by allowing the support unit to be foldable.

Another goal of this invention aims to provide a bent over row machine capable of exercising by changing the weight to a desired weight.

Also, this invention also aims to provide a bent over row machine with a handle unit capable of adjusting the relevant angle where its overgrip and handgrip changes are adjusted conveniently.

Means to Resolve Tasks

The bent over row machine according to an embodiment of this invention is coupled to the base frame placed in contact with the ground and the upper surface of the base frame and fixed at the main frame, which stands upright in the vertical direction, and at one point on the upper surface of the base frame, providing support for the user's body capable of folding. Also, it includes a support unit capable of adjusting its standing angle and height, a pair of rotational movement units linked to the main frame and leveled downwards on both sides of the support unit, which are coupled to one end of each of the pair of rotational movement units, allowing the user to hold and rotate the rotational movement unit. A pair of handle units that can adjust their angles are placed at a slanted angle on the other side of the upper surface of the base frame, which is combined to one side of the primary stool unit and the base frame in which the user's feet are supported when the user is standing and may include a secondary stool to provide support for the user's feet when the user is leaning on the support unit.

In addition, the support unit according to an embodiment of this invention includes a primary support seat to support the chest and abdomen of the user, a secondary support seat to support the hip of the user, a handle for folding the seats prepared on one side of the secondary support seat, a length adjustment unit that adjusts the height and angle of the primary support seat and the distance between the primary and the secondary support seats, and a folding unit that allows for the primary and secondary support seats to fold in the direction of the main frame.

In addition, the rotational movement unit according to an embodiment of this invention primarily links to the main frame with the primary frame bent at a primary angle and both ends linked to the upper surface of the primary frame, and it includes protrusions at the secondary frame bent at a secondary angle and multiple points of the primary and the secondary frames to provide multiple mounting bars to fix heavy goods.

In addition, the handle unit according to an embodiment of this invention is provided to include an angle adjustment plate linked to one end of the rotational movement unit with multiple angle adjuster, a rotating shaft fixed to a single side of the angle adjustment plate in a bent pipe shape. It also includes an angle fixing pin in which a single end of the primary handle is fixed to the rotating shaft in a bent pipe shape, followed by an end linked to the secondary handle and the rotation shaft fixed to the rotation shaft to be rotated around the shaft, and inserted into the angle adjuster to fix the angles of the primary and secondary handles.

In addition, the secondary scaffolding unit according to an embodiment of this invention may include a length-adjusting frame with multiple length adjusters when the base frame is axially coupled at one point, a length-adjusting pin prepared at a single point on the upper surface of the base frame, and a scaffolding bar linked to a single end of the length-adjusting frame.

Effects of the Invention

This invention aims to provide a bent over row machine capable of effectively performing exercises in a correct posture via a support unit capable of supporting the user's body.

This invention also aims to provide a bent over row machine capable of adjusting the relevant height and angle of a support unit according to various types of users' bodies.

In addition, this invention aims to provide a bent over row machine with a foldable support unit capable of performing exercises not only in a position in which the chest and abdomen are supported but also in a bent-over state.

Another goal of the bent over row machine according to an embodiment of this invention aims to provide a machine capable of exercising by changing the weight to a desired weight.

Also, the goal of the bent over row machine according to an embodiment of this invention aims to provide a machine with a handle unit capable of adjusting the relevant angle where its overgrip and handgrip changes are adjusted conveniently.

BRIEF DESCRIPTION OF DRAWINGS

Drawing 1 shows a bent over row machine according to an embodiment of this invention.

Drawing 2 shows a support unit according to an embodiment of this invention.

Figure 1:
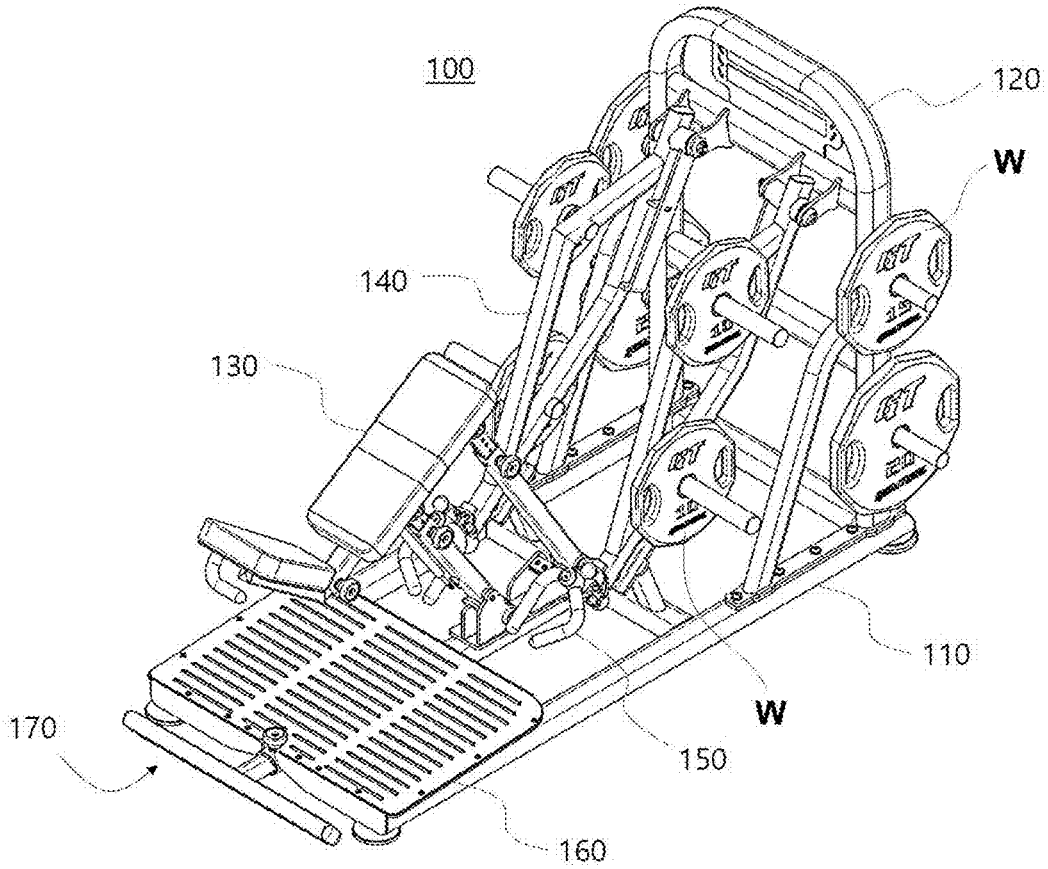
Figure 2:
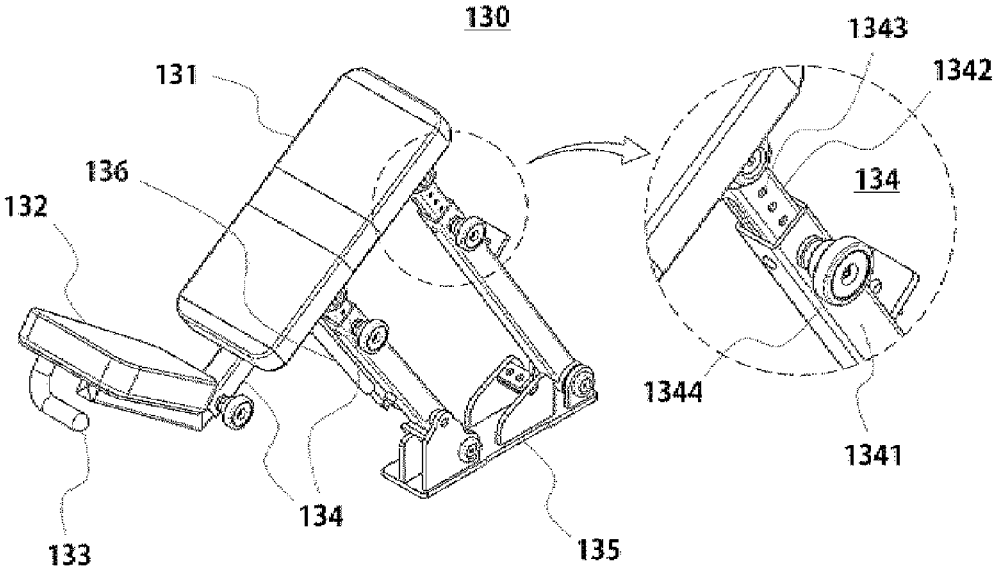
Figure 3:
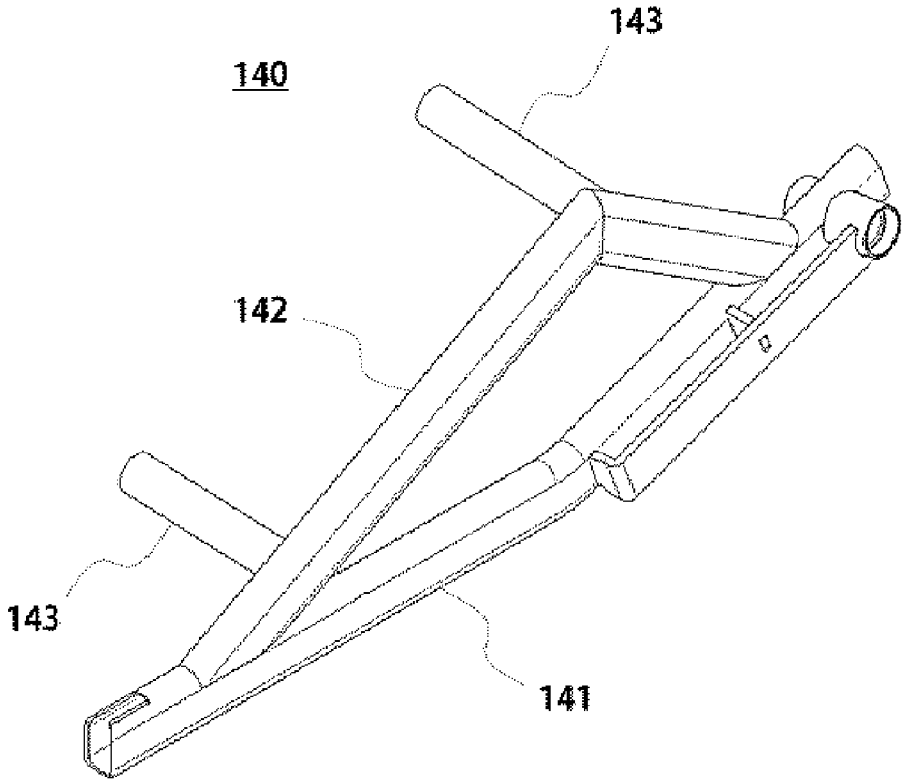
Figure 4:
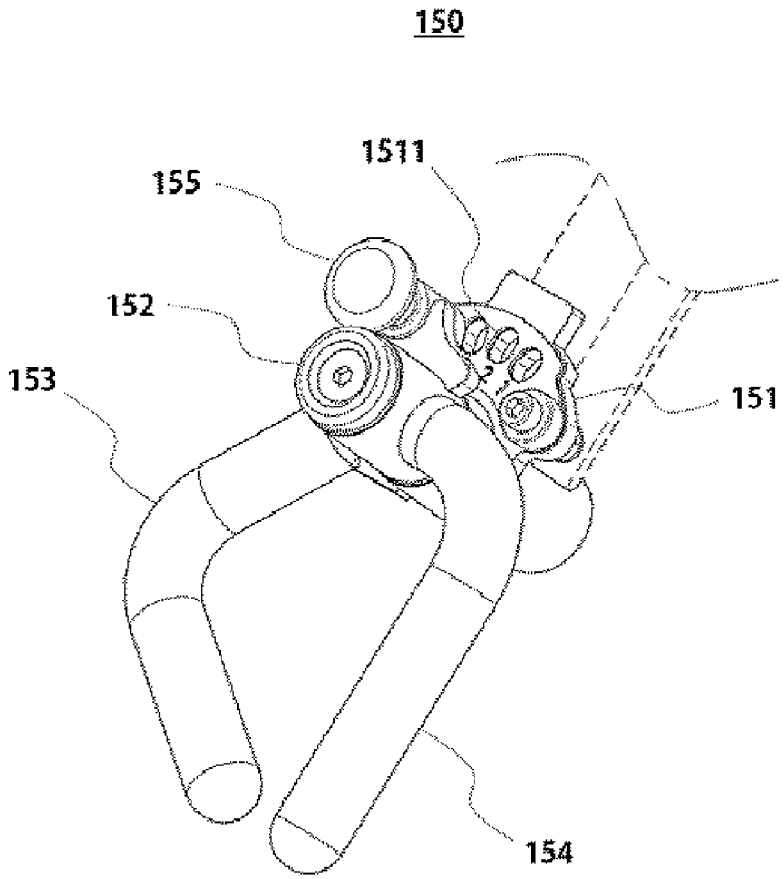
Figure 5:
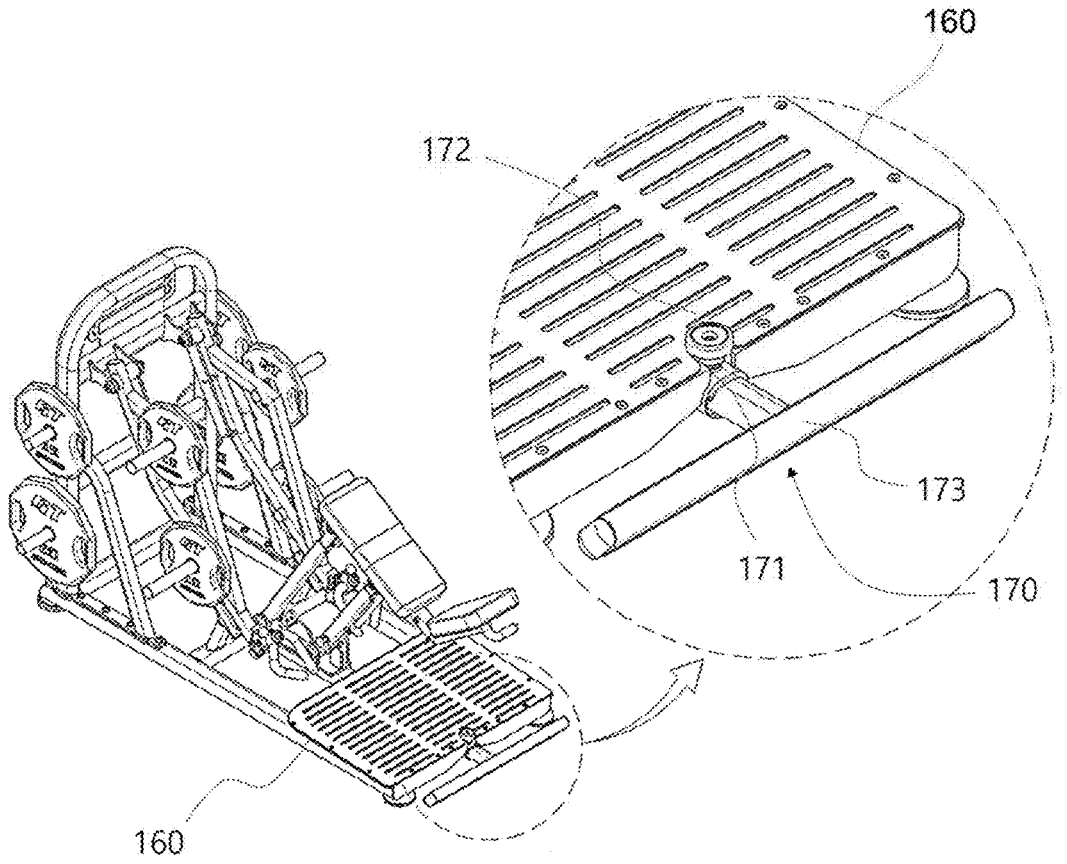
Figure 6:
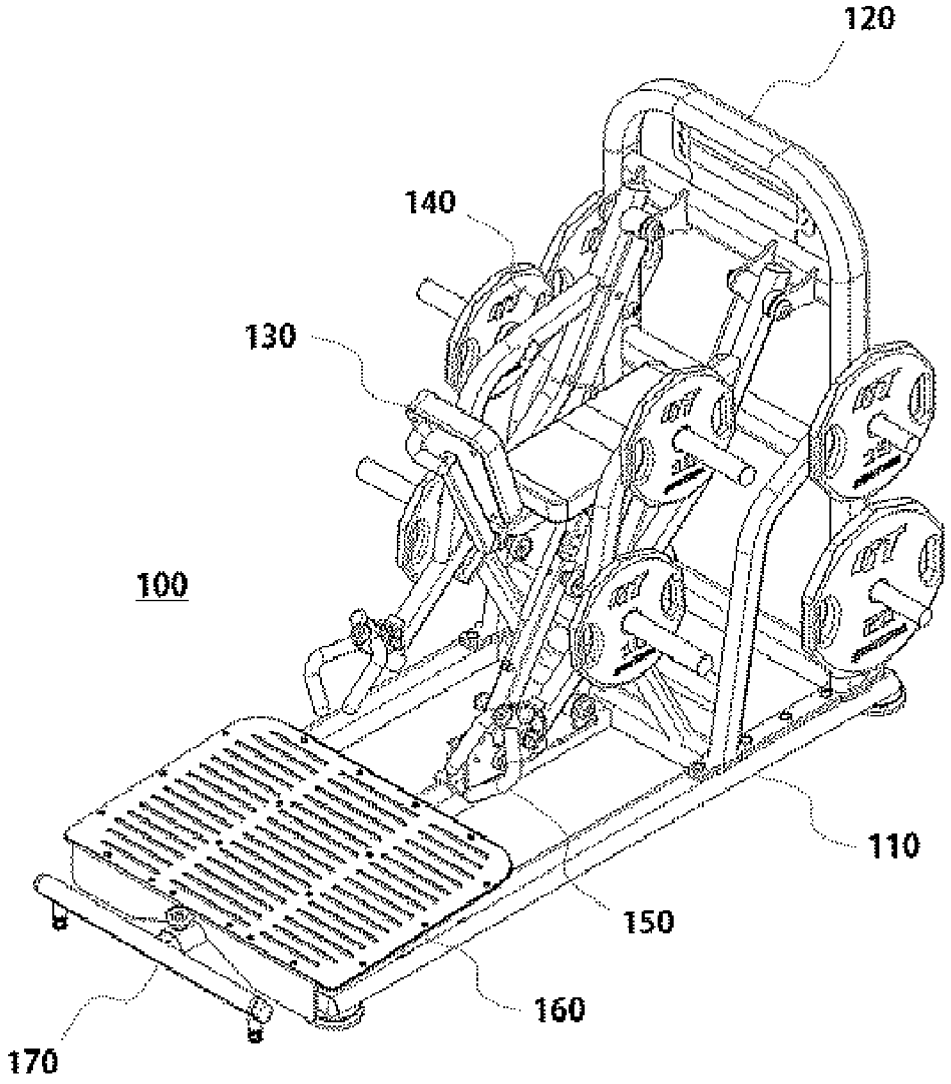

Drawing 3 shows a rotational movement unit according to an embodiment of this invention.

Drawing 4 shows a handle unit according to an embodiment of this invention.

Drawing 5 shows a secondary scaffolding unit according to an embodiment of this invention.

Drawing 6 shows a folding state of the bent over row machine according to an embodiment of this invention.

DETAILED DESCRIPTION

Specific embodiments of this invention will be described in detail with reference to the drawings below. However, ideas concerning this invention shall not be limited to the presented examples, and the person skilled in the relevant field of technology will be able to easily suggest other regressive inventions or other embodiments that are included within the scope of the relevant idea by adding, changing, or deleting other elements within the scope of the same relevant ideas. However, it would also be included within the scope of the ideas relevant to this invention.

The bent over row machine (100) of this invention will be described in detail with reference to the attached Drawings 1 or 5.

Drawing 1 shows a bent over row machine (100) according to an embodiment of this invention.

In reference to Drawing 1, the bent row machine (100) according to an embodiment of this invention includes a base frame (110), a main frame (120), a support unit (130), a rotational movement (140), a handle unit (150), the primary scaffolding unit/plate member (160) and the secondary scaffolding unit (170).

The base frame (110) may be placed to come in contact with the ground. The base frame (110) may be prepared via coupling of multiple horizontal and vertical frames.

The main frame (120) may be coupled to one side of the upper surface of the base frame (110) and stand upright in the vertical direction. The main frame (120) may be bolted to the upper surface of the base frame (110). Mounting bars may be prepared on both sides of the main frame (120) to store heavy goods (W).

The foldable support unit (130) is fixed at a single point on the upper surface of the base frame (110), which can provide support the user's body, and it is capable of adjusting the angle and height of the upright position. The above support unit (130) will be studied in more detail with reference to Drawing 2.

Drawing 2 shows a support unit (130) according to an embodiment of this invention.

In reference to Drawing 2, the support unit (130) according to an embodiment of this invention includes a primary support seat (131), a secondary support seat (132), a handle for folding the seats (133), a length adjustment unit (134), and a folding unit (135).

The primary support seat (131) may be prepared to support the chest and abdomen of the user.

A secondary support seat (132) may be prepared to support the hip of the user.

The handle for folding the seats (133) may be prepared on one side of the secondary support seat (132). The handle for folding the seats (133) may be prepared in a bent pipe shape. The handle for folding the seats (133) specified above may offer the user to hold and exercise using the support unit (130) in a folded state.

As for the length-adjusting unit (134), it adjusts the height and angle of the primary support seat (131) and the distance between the primary (131) and the secondary support seats (132). The length adjusting unit (134) may include a primary adjusting frame (1341), a secondary adjusting frame (1342), a length-adjusting hole (1343), and a length fixing pin (1344).

The primary adjusting frame (1341) may be prepared in the shape of a hollow rectangular frame.

The secondary adjusting frame (1342) may be prepared in a rectangular frame shape and can be inserted into the interior of the primary adjusting frame (1341).

Multiple length-adjusting holes (1343) may be prepared on one surface of the secondary adjusting frame (1342).

The length fixing pin (1344) passes through a single point on one side of the primary adjusting frame (1341) and it is inserted into the length-adjusting hole (1343) at one end for length adjustment. An elastic body may be prepared in the interior of the length fixing pin (1344).

The folding unit (135) may fold the primary support seat (131) and the secondary support seat (132) in the direction of the main frame (120). The folding unit (135) may be prepared in a plate shape with multiple protrusions with a single end of the length-adjusting unit (134) linked to be rotatable. An unfolding state may be fixed by inserting a folding fixing pin (not shown) prepared at an end of the length-adjusting unit (134) into a folding fixing hole (not shown).

The folding state of the bent over row machine (100) will be studied in more detail with reference to Drawing 6.

Drawing 6 shows a folding state of the bent over row machine according to an embodiment of this invention.

In reference to Drawing 6, the folding fixing pin (not shown) may be released from its fixed state to allow for the primary (131) and the secondary support seats (132) to be folded in the direction of the main frame (120). In addition, multiple anti-collision units (not shown) may be prepared at multiple points of the folding unit (135) to prevent collision of the length-adjusting unit (134) in a folded state. This bent over row machine has a folding unit (135) with a foldable support unit (130) capable of performing exercises not only in a position in which the chest and abdomen are supported but also in a bent-over state.

In addition, the support unit (130) may further include a damper (136).

The damper (136) is prepared on one side of the length-adjusting unit (134), which allows for the primary support seat (131) to be raised for length adjustment when the length of the length-adjusting unit (134) is released from its fixed state.

In reference to Drawing 1 again, a pair of rotational movement units (140) is linked to the main frame (120) and leveled downwards on both sides of the support unit (130).

The above rotational movement unit (140) will be studied in more detail with reference to Drawing 3.

Drawing 3 shows a rotational movement unit (140) according to an embodiment of this invention.

In reference to Drawing 3, the rotational movement unit (140) according to an embodiment of this invention includes a primary frame (141), a secondary frame (142), and a mounting bar (143).

The primary frame (141) may be linked to the main frame (120) above and bent at a primary angle.

The secondary frame (142) may be linked to the upper surface of the primary frame (120) above and bent at a secondary angle. The cross sections of the primary frame (141) and the secondary frame (142) may be prepared in an elliptical shape.

The mounting bar (143) protrudes from multiple points of the primary frame (141) and the secondary frame (142) and they may be prepared in multiple counts to fix heavy goods (W).

In reference to Drawing 1 again, a pair of handle units (150) are linked to one end of each pair of rotational movement units (140) to allow for the user to hold and rotate the rotational movement unit (140) while adjusting its angles. The above handle unit (150) will be studied in more detail with reference to Drawing 4.

Drawing 4 shows a handle unit (150) according to an embodiment of this invention.

In reference to Drawing 4, the handle unit (150) according to an embodiment of this invention includes an angle adjustment plate (151), a rotating shaft (152), a primary handle (153), a secondary handle (154), and an angle fixing pin (155).

The angle adjustment plate (151) can be linked to a single end of the rotational movement unit (140) and may consist of multiple angle adjusters (1511).

The rotating shaft (152) may be fixed to one side of the angle adjusting plate (151).

The primary handle (153) may be provided in a bent pipe shape with a single end fixed to the rotating shaft (152).

The secondary handle (154) may be provided in a bent pipe shape with a single end fixed to the rotating shaft (152).

The angle fixing pin (155) can be coupled to the rotation shaft (152) to be rotated around the shaft (152), and it is inserted into the angle adjuster (1511) to fix the angles of the primary (153) and secondary handles (154).

By preparing a handle unit (150) to be angle-adjustable, it allows for users to perform exercises with the handle at the most comfortable angle according to one's posture where its overgrip and handgrip changes are adjusted conveniently.

In reference to Drawing 1 again, the primary scaffolding unit/plate member (160) can be placed at a slanted angle on the other side of the upper surface of the base frame (110) to support the user's feet when the user is standing.

The secondary scaffolding unit (170) is combined to a single side of the base frame (110) above, and it can provide support for the user's feet when the user is leaning on the support unit. The secondary scaffolding unit (170) will be studied in more detail with reference to Drawing 5.

Drawing 5 shows a secondary scaffolding unit (170) according to an embodiment of this invention.

In reference to Drawing 5, the secondary scaffolding unit (170) according to an embodiment of this invention includes a length-adjusting frame (171), length-adjusting pin (172), and a scaffolding bar (173).

The length-adjusting frame (171) can include a base frame (110) axially coupled at one point and multiple length adjusters (not shown).

The length-adjusting pin (172) may be prepared on one surface of the base frame (110).

The scaffolding bar (173) may be coupled to a single end of the length-adjusting frame (171).

Since the length of the secondary scaffolding unit (170) is provided to be adjustable, it is capable of corresponding to diverse heights of users.

As observed above, this invention aims to provide a bent over row machine capable of effectively performing exercises in a correct posture via a support unit capable of supporting the user's body, and adjust the relevant height and angle of a support unit according to various types of users' bodies.

This bent over row machine has a folding unit with a foldable support unit capable of performing exercises not only in a position in which the chest and abdomen are supported but also in a bent-over state, which can be performed by changing the weight to a desired weight, and by preparing a handle unit to be angle-adjustable, it allows for users to perform exercises with the handle where its overgrip and handgrip changes are adjusted conveniently.

Limited examples and drawings of this invention have been described above based an embodiment of this invention, however, the ideas concerning this invention shall not be limited to the presented examples, and it evidently states that the person skilled in the relevant field of technology is capable of making changes and modifications within the scope of the relevant idea. Therefore, one embodiment of this invention should be identified only by the claims described below, and it is clear that such changes or modifications shall belong to the appended scope of a request for a patent.

DESCRIPTION OF SIGNS

100: Bent Over Row Machine
110: Base frame
120: Main frame
130: Support unit
131: Primary support
132: Secondary support seat
133: Handle for folding seats
134: Length-adjusting unit
135: Folding unit
136: Damper
140: Rotational movement unit
141: Primary frame
142: Secondary frame
143: Mounting bar
150: Handle unit
151: Angle adjustment plate
152: Rotational shaft
153: Primary handle
154: Secondary handle
155: Angle fixing pin
160: Primary scaffolding unit/plate member
170: Secondary scaffolding unit
171: Length-adjusting frame
172: Length-adjusting pin
173: Scaffolding bar

The invention claimed is:

1. A bent over row machine comprising:

a base frame placed to come in contact with the ground;

a main frame coupled to one side of an upper surface of the base frame and stands upright in a vertical direction;

a support unit fixed on the upper surface of the base frame, the support unit being configured to support a user's body, and to adjust an angle and a height of an upright position;

a pair of rotational movement units linked to the main frame and extending downward on both sides of the support unit;

a pair of handle units each linked to one end of each of the pair of the rotational movement units to allow the user to hold and rotate the rotational movement units while adjusting angles thereof;

a primary scaffolding unit placed at a slanted angle on the other side of the upper surface of the base frame, opposite the main frame, the primary scaffolding unit comprising a plate member to support the user's feet when the user is standing; and a secondary scaffolding unit coupled to a side of the base frame to support the user's feet when the user is leaning on the support unit, wherein the support unit includes:

a primary support seat configured to support the user's chest and abdomen;

a secondary support seat configured to support the user's hip;

a handle for folding the seats provided on a bottom surface of the secondary support seat;

a length-adjusting unit configured to adjust a height of the primary support seat and a distance between the primary and the secondary support seats;

a folding unit configured to fold the primary support seat and the secondary support seat toward the main frame; and a damper provided to a side of the length-adjusting unit and configured to damp a movement of the primary support seat.

2. The bent over row machine according to claim 1, wherein the rotational movement unit includes:

a primary frame linked to the main frame and bent at a primary angle;

a secondary frame linked to an upper surface of the primary frame and bent at a secondary angle; and at least one first mounting bar protruding from the primary frame and at least one second mounting bar protruding from the secondary frame, wherein the at least one first mounting bar fixes heavy goods to the primary frame, and the at least one second mounting bar fixes heavy goods to the secondary frame.

3. The bent over row machine according to claim 1, wherein the handle unit includes:

an angle adjustment plate linked to an end of the rotational movement unit with multiple angle adjusters;

a rotating shaft fixed to a side of the angle adjustment plate;

a primary handle provided in a bent pipe shape with an end thereof fixed to the rotating shaft;

a secondary handle provided in a bent pipe shape with an end thereof fixed to the rotating shaft; and an angle fixing pin coupled to the rotation shaft to be rotated around the shaft and inserted into the angle adjuster to fix angles of the primary and secondary handles.

4. The bent over row machine according to claim 1, wherein the secondary scaffolding unit includes:

a length-adjusting frame axially coupled to the base frame; and a scaffolding bar coupled to an end of the length-adjusting frame and extending normal to the length-adjusting frame.

5. The bent over row machine according to claim 1, wherein the damper is configured to raise the primary support seat while the length-adjusting unit adjusts the height of the primary support seat.

6. The bent over row machine according to claim 1, wherein the length-adjusting unit includes:

a primary adjusting frame linked to the folding unit;

a secondary adjusting frame linked to the primary support seat and movably inserted into the primary adjusting frame;

multiple length-adjusting holes provided on a surface of the secondary adjusting frame; and a length fixing pin passing through a side of the primary adjusting frame and inserted into any one of the multiple length-adjusting holes to place the length-adjusting unit in a fixed state, and wherein the damper is configured to raise the primary support seat for length adjustment, when the length-adjusting unit is released from the fixed state.

7. The bent over row machine according to claim 6, wherein the damper is linked to the primary support seat and the primary adjusting frame.

8. The bent over row machine according to claim 1, wherein the secondary support seat is configured to move along a longitudinal axis of the primary support seat using the length-adjusting unit, to adjust the distance between the primary and secondary support seats.

9. The bent over row machine according to claim 1, wherein when the primary and secondary support seats are folded toward the main frame by the folding unit, the primary support seat is placed between the pair of rotational movement units while being oriented horizontally, and the secondary support seat is oriented vertically such that the handle for folding the seats on the bottom surface thereof is exposed to the user to be gripped by the user.

* * * * *